US007649980B2

(12) United States Patent
Aoki et al.

(10) Patent No.: US 7,649,980 B2
(45) Date of Patent: Jan. 19, 2010

(54) X-RAY SOURCE

(75) Inventors: Nobutada Aoki, Otawara (JP); Akiko Kakutani, Tokyo (JP); Tsuyoshi Sugawara, Chigasaki (JP); Motosuke Miyoshi, Tokyo (JP)

(73) Assignees: The University of Tokyo, Tokyo (JP); Toshiba Electron Tubes & Devices Co., Ltd., Tochigi-Ken (JP)

( * ) Notice: Subject to any disclaimer, the term of this patent is extended or adjusted under 35 U.S.C. 154(b) by 65 days.

(21) Appl. No.: 11/950,167

(22) Filed: Dec. 4, 2007

(65) Prior Publication Data

US 2008/0304624 A1 Dec. 11, 2008

(30) Foreign Application Priority Data

Dec. 4, 2006 (JP) ..... 2006-326831

(51) Int. Cl.
*H01J 35/14* (2006.01)

(52) U.S. Cl. ..... 378/138; 378/137

(58) Field of Classification Search ..... 378/137–138, 378/119

See application file for complete search history.

(56) References Cited

U.S. PATENT DOCUMENTS 5,199,054 A 3/1993 Adams et al.
2004/0218723 A1 * 11/2004 Okada et al. ..... 378/138

FOREIGN PATENT DOCUMENTS

JP 2004-028845 1/2004
JP 2004-234993 8/2004
SU 748577 7/1980

OTHER PUBLICATIONS

United Kingdom Search Report dated Mar. 31, 2008 for Appln. No. 0723631.8.

* cited by examiner

*Primary Examiner*—Hoon Song
(74) *Attorney, Agent, or Firm*—Pillsbury Winthrop Shaw Pittman, LLP

(57) ABSTRACT

A transmission target of a vacuum container is operable to have a ground potential and an electro-optical system is floated at a positive potential in the vacuum container. An electron beam, which is converged by means of the electro-optical system, is decelerated immediately before the electron beam is incident to the transmission target. The electron beam has energy that is several times of the final set value until the electron beam passes through the electro-optical system, and a divergence action exerted by a spatial electric charge effect is reduced. Color aberration of the electro-optical system is proportional to energy of the electron beam. Thus, if the electron beam is decelerated after the electron beam has passed through the electro-optical system, aberration is reduced in proportion to the degree of deceleration, making it possible to concurrently reduce a focus size.

10 Claims, 4 Drawing Sheets

| | Thickness [μm] | Density [g/cm$^2$] | X-ray damping rate | | Thermal conductivity [W/mk] | Thermal expansibility [x1e-6/℃] |
|---|---|---|---|---|---|---|
| | | | E=1keV | E=2keV | | |
| Be | 30 | 1.85 | 0.035 | 0.66 | 18.9 | 14.2 |
| SiN | 0.1 | 3.3 | 0.95 | 0.91 | 20~27 | 2.6~3.2 |

FIG. 5

| Target | Atomic number | Lα energy [keV] | Temperature at which steam pressure 1e-6Pa is reached [℃] | Re-crystallization temperature [℃] |
|---|---|---|---|---|
| Zr | 40 | 2.042 | 1500 | — |
| Nb | 41 | 2.166 | 1700 | — |
| Mo | 42 | 2.293 | 1500 | 11500~1200 |
| Rh | 45 | 2.697 | 1200 | 1400 |
| Ta | 73 | 8.145 | 1900 | — |
| W | 74 | 8.396 | 2050 | 1650 |

FIG. 6A

| Target | Atomic number | Lα energy [keV] | Temperature at which steam pressure 1e-6Pa is reached [℃] |
|---|---|---|---|
| Ti | 22 | 4.504 | 1000 |
| V | 23 | 4.944 | 1100 |

FIG. 6B

X-RAY SOURCE

CROSS-REFERENCE TO RELATED APPLICATIONS

This application is based upon and claims the benefit of priority from prior Japanese Patent Application No. 2006-326831, filed Dec. 4, 2006, the entire contents of which are incorporated herein by reference.

BACKGROUND OF THE INVENTION

1. Field of the Invention

The present invention relates to an X-ray source for radiating X-rays with low energy at a microscopic focus.

2. Description of the Related Art

A general X-ray source having a microscopic focus has already been produced as a micro-focus X-ray source, and is widely used in equipment such as a nondestructive inspection apparatus for inspecting a microscopic area of a target at a high resolution. This X-ray source employs a configuration in which electron beams radiated from an electron source are converged by means of an electro-optical system such as an electric field or magnetic field lens, a focus is provided in a small area that is equal to or smaller than the order of micrometers on a surface of a transmission target, and the X-rays are radiated at the focus while the transmission target is transmitted (refer to, for example, Jpn. Pat. Appln. KOKAI Publication No. 2004-28845 (pages 4 to 5 and FIG. 1)).

It is important to make a design while obtaining matching between an electron source and an electro-optical system in order to converge electron beams at a small spot with a constant amount of current, whereas an X-ray source having a microscopic focus close to 0.1 μm is achieved by making a variety of contrivances at the present stage.

An X-ray source that carries out transmission exposure of an inspection target at a high resolution is required to have the microscopic focus as described above in achieving a spatial resolution, whereas it becomes important to enable radiation of X-rays with energy suitable to achieve high contrast. This is because, when transmission exposure of an inspection site in a microscopic area is carried out, if the energy of X-rays to be used is too high, the contrast of an exposure image cannot be obtained, making it impossible to judge the presence or absence of a defect.

Most of the current micro-focus X-ray sources are driven at a high voltage equal to or greater than 70 or 150 kV, and radiate X-rays with high energy. However, in the case where an inspection target is a small sample having size of several tens of μm, or a constituent element thereof is a light element with a small X-ray damping rate, in particular, an organic substance, it becomes necessary to use X-rays with low energy covering a soft X-ray area, which is equal to or smaller than 30 keV, or occasionally, equal to smaller than 5 keV. Further, in recent years, there has been a growing demand for high resolution inspection in the field of products in which organic materials are frequently used, in the field of pharmaceutics and relative to microscopic targets composed of light elements such as cells. Therefore, a need exists for practical use of an X-ray source having a microscopic focus, which is capable of radiating X-rays with low energy covering the soft X-ray area described above.

However, in the case where it becomes possible to radiate X-rays with low energy with a conventional configuration of a micro-focus X-ray source kept unchanged, this caused the following problems to be solved.

The physical constraints that occur when an attempt is made to converge electron beams with low energy in a small area primarily include two problems described below. One problem is that a divergence action occurs due to a spatial electric charge effect at the time of crossover of electron beams in an electro-optical system. The other problem is that, with lower energy, the blurring quantity of a focus on an image forming face increases under the strong influence of the magnetic field of the electro-optical system or color aberration of an electric field lens.

The physical constraints in achieving radiation intensity (dosage) of X-rays with low energy primarily include two problems described below. One of these problems is that it is disadvantageous to apply electron beams with low energy from the viewpoint of increase in dosage because the radiation quantity of controlled X-rays is substantially proportional to energy of excitation electrons. The other problem is that it becomes difficult to achieve radiation intensity of X-rays with low energy due to the attenuation (absorption) effect associated with transparent target.

Therefore, it is impossible to maintain the initial microscopic focus size merely by reducing and operating a drive voltage of a current micro-focus X-ray source with high energy. In addition, it is difficult to include the limit of an achievable focus size in a satisfactory range merely by making a design change so as to cope with low voltage driving with a configuration thereof kept unchanged. For this reason, a contrivance on the configuration of the X-ray source is required to achieve microscopic focus performance, which is capable of reducing energy and radiating soft X-rays with sufficient intensity (dosage) at high efficiency, and which is equal to or more excellent than that of the current micro-focus X-ray source with high energy.

BRIEF SUMMARY OF THE INVENTION

The present invention has been made in view of the circumstance described above. It is an object of the present invention to provide an X-ray source, which is capable of radiating X-rays with low energy and ensuing focus size performance equal to or more excellent than that of a current micro-focus X-ray source with high energy.

The present invention provides an X-ray source comprising: a vacuum container provided with a transmission target with a ground potential; an electron source which is accommodated in the vacuum container to be insulated from a ground potential, and generates an electron beam; an electro-optical system which is accommodated in the vacuum container to be insulated from a ground potential, and converges the electron beam generated by the electron source; and a drive power source which distributes electric potential so as to accept a deceleration action immediately before the electron beam converged by the electro-optical system is incident to the transmission target.

According to the present invention, there can be provided an X-ray source, which is configured to accept a deceleration effect immediately before electron beams converged by means of an electro-optical system are incident to a transmission target with a ground potential, so that the electron beams have energy that is several times of a final setting until they have passed through the electro-optical system, making it possible to reduce a divergence action that is exerted by a spatial electric charge effect, and in which color aberration is proportional to energy of the electron beams in a variety of aberrations of the electro-optical system as it is, thus employing a configuration of achieving deceleration after the electron beams have passed through the electro-optical system, thereby reducing aberration in proportion to the degree of deceleration, enabling concurrent reduction of a focus size, and therefore, radiating X-rays with low energy at a microscopic focus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 5 is a chart showing a characteristic comparison in the case where a substrate of the same transmission target is made of Be and SiN;

FIG. 6A is a chart showing a material when characteristic X-rays of the same transmission target are radiated;

FIG. 6B is a chart showing a material when characteristic X-rays of the same transmission target are radiated;

DETAILED DESCRIPTION OF THE INVENTION

Figure 1:
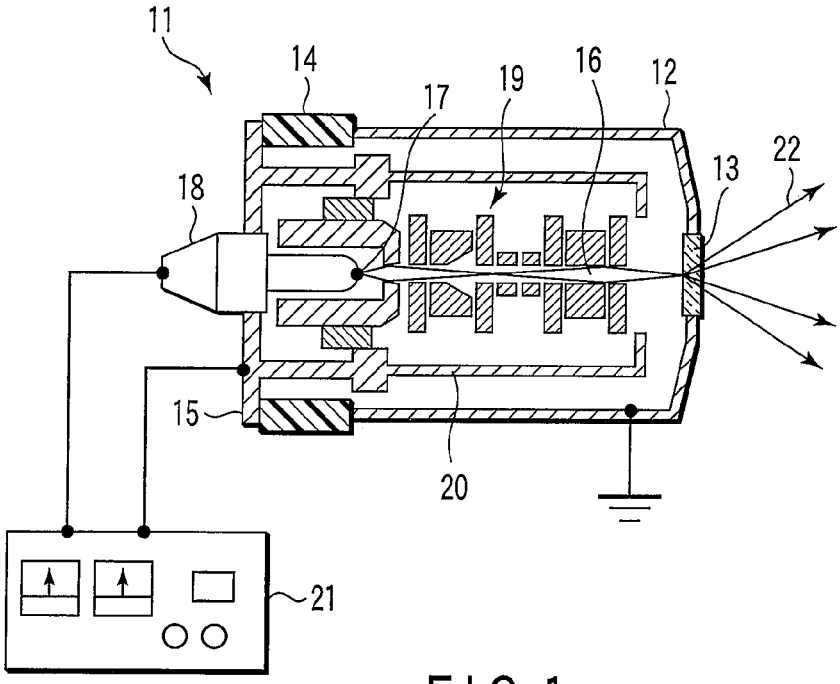
FIG. 1 is an illustrative view of an X-ray source showing a first embodiment of the present invention.

FIG. 1 shows a first embodiment of an X-ray source 11.

The X-ray source 11 has a vacuum container 12, an inside of which is maintained in vacuum, and a transmission target 13 compatible with an X-ray radiation window for externally radiating X-rays is arranged at one end of this vacuum container 12.

At the other end of the vacuum container 12, a support member 15 is arranged while an insulation cylinder 14 serving as an insulation member is interposed. On the support member 15, there are arranged an electron gun 18 having an electron source 17 for generating electron beams 16 toward the transmission target 13, and an electrostatic electro-optical system 19 having equipment such as an electrostatic lens (gun lens), for example, for converging, deflecting, and further, aberration-correcting the electron beams 16 located in the vacuum container 12 and generated from the electron source 17 to make them incident to the transmission target 13. On the support member 15, a cover portion 20 is formed as being interposed between the vacuum container 12 and the electro-optical system 19 to cover the electro-optical system 19, the cover portion having an opened face that is distantly opposed to the transmission target 13. The support member 15, the electron gun 18, and the electro-optical system 19 are electrically insulated from the vacuum container 12 via the insulation cylinder 14.

A drive power source 21 for generating the electron beams 16 is connected to the electron gun 18.

The vacuum container 12 and the transmission target 13 are set to have ground potentials, and a positive voltage is applied from the drive power source 21 to the support member 15 and the electro-optical system 19 so as to accept a deceleration action immediately before the electron beams 16 converged by means of the electro-optical system 19 pass through the electro-optical system 19 and are incident to the transmission target 13.

Figure 7A:
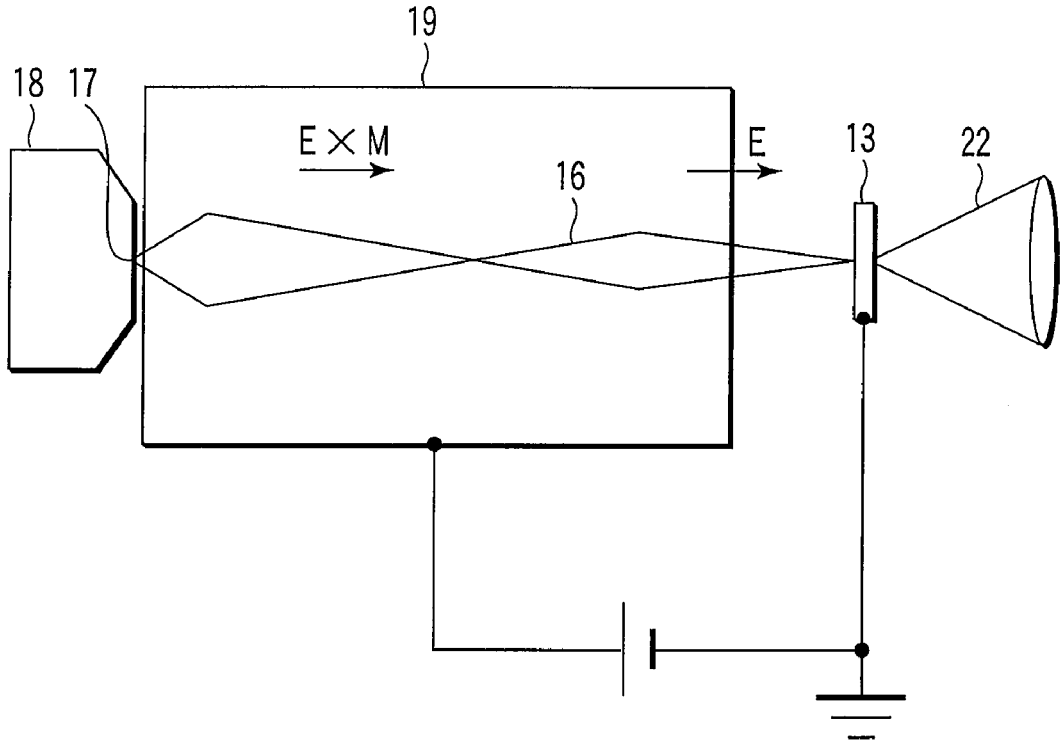
FIG. 7A is an illustrative view in the case where each of the same X-ray sources has a deceleration action.

Now, a means for converging the electron beams 16 with low energy at a microscopic focus will be described with reference to FIG. 7A. For example, let us consider that a scanning type electron miscoscope (SEM) or a deceleration type electro-optical system as applied in electron beam exposure equipment is applied to an X-ray source configuration.

Figure 7B:
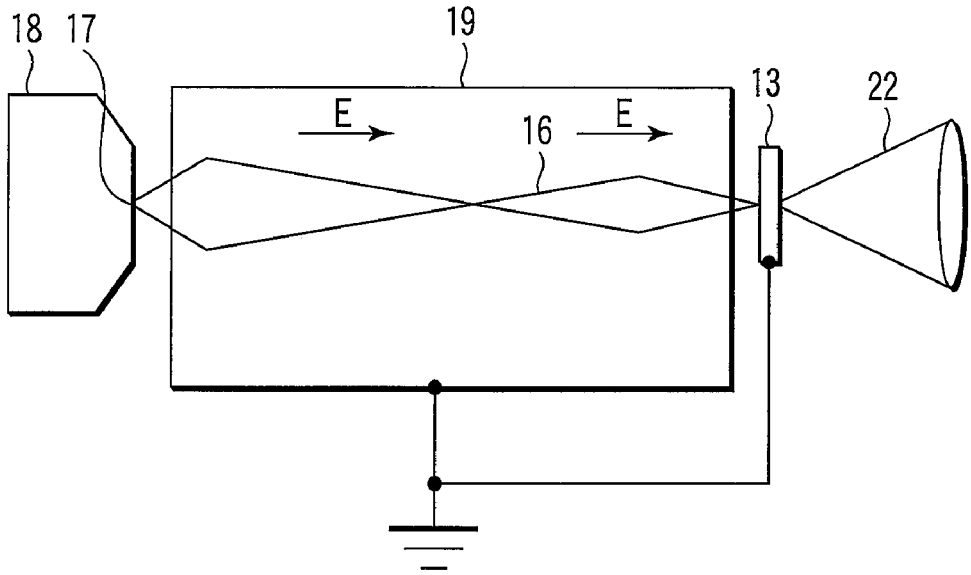
FIG. 7B is an illustrative view of a comparative example in the case where each of the same X-ray sources does not have a deceleration action.

In this case, a mechanism is employed such that the electron beams 16 are operable to have several times M of energy E that is finally set, until the beams have passed through the electro-optical system 19 composed of an electric field or magnetic field lens, and then the beams are decelerated to the target E immediately before reaching the transmission target 13. The scanning type electron miscoscope (SEM) or electron beam exposure equipment employs a configuration in which a large negative voltage is applied to samples, thereby achieving this process. However, it is difficult to apply a similar configuration because applying a large negative voltage to samples by the X-ray source 11 to achieve potential floating causes large constraint on a system of inspection equipment. Therefore, in order to obtain a deceleration mechanism with the transmission target 13 being a ground potential, a configuration is employed such that the same effect can be attained by floating the electro-optical system 19 at a positive potential in the X-ray source 11. FIG. 7B is provided as a comparative example equivalent to a conventional technique, wherein the electron beams 16 pass through the electro-optical system 19 at the energy E that is finally set, so that, as described above, a divergence action occurs due to a spatial electric charge effect at the time of crossover of the electron beams 16 in the electro-optical system 19, and with lower energy, the blurring quantity of a focus on an image forming face increases under the strong influence of the color aberration of a lens of the electro-optical system 19.

As described above, this X-ray source is configured so as to accept a deceleration action immediately before the electron beams 16 converged by means of the electro-optical system 19 are incident to the transmission target 13, so that the electron beams 16 have energy that is several times of the final set value until they have passed through the electro-optical system 19, thus making it possible to reduce the influence (the degree of divergence) exerted by a spatial electric charge effect in reverse proportion to the 3/2 order of energy. In other words, the degree of divergence is reduced to 0.19 time by carrying out a deceleration of 1/3.

Among a variety of aberrations of the lens of the electro-optical system 19, color aberration is proportional to energy as it is, so that a configuration of carrying out deceleration after the electron beams have passed through the lens of the electro-optical system 19 is employed, thereby reducing aberration in proportion to the degree of deceleration and enabling concurrent reduction of a focus size.

Therefore, the electron beams can pass through the electro-optical system 19 with higher energy than that of the electron beams 16 incident to the transmission target 13, so that the divergence action exerted by the spatial electric charge effect at an image forming point of the electron beams 16 in the electro-optical system 19 is reduced, and further, color aberration can be reduced among the aberrations of a lens configuring the electro-optical system 19.

By means of the action of restraining divergence of the electron beams 16, the focus of the electron beams 16 at an incident point of the transmission target 13 can be reduced more remarkably than that obtained when the electron beams 16 are passed from a point of generation to a point of incidence to the transmission target 13 with a constant low energy, and X-rays 22 can be radiated from a small focus.

Accordingly, there can be provided an X-ray source 11, which is capable of radiating X-rays with low energy at a microscopic focus.

In order to cause the transmission target 13 to have the same ground potential as that of the vacuum container 12 in configuring the X-ray source 11, when a configuration is employed such that the electron source 17 and the electro-optical system 19 are installed while being insulated from the vacuum container 12 to electrically float them, it is possible to employ a configuration of installing an insulation material inside the vacuum container 12 to support these electron source 17 and electro-optical system 19 in addition to installing the insulation cylinder 14 relative to the vacuum container 12, as shown in FIG. 1.

Further, it is also possible to employ a configuration such that the vacuum container 12 is made of an insulation material such as glass, the transmission target 13 has a ground potential, and other constituent elements are operable to float at a positive potential.

Furthermore, the electro-optical system 19, with which the X-ray source is equipped, has at least one electrostatic lens (gun lens) in order to provide a function of drawing and converging electron beams from the electron source 17. This electro-optical system can be configured so as to be monolithic. Further, in order to enhance controllability of electron beams to be converged, it is preferable that the electro-optical system be provided with another lens, and further, be provided with a deflection quadruple for aligning (axially adjusting) the electron beams 16 incident thereto and an octpole for correcting non-point aberration of the electron beams. As these added lens and multi-poles, it is possible to apply magnetic field type (coil) poles as well as to apply electrostatic poles in which a plurality of electrodes are arranged with an insulation, as shown in FIG. 1.

Figure 2:
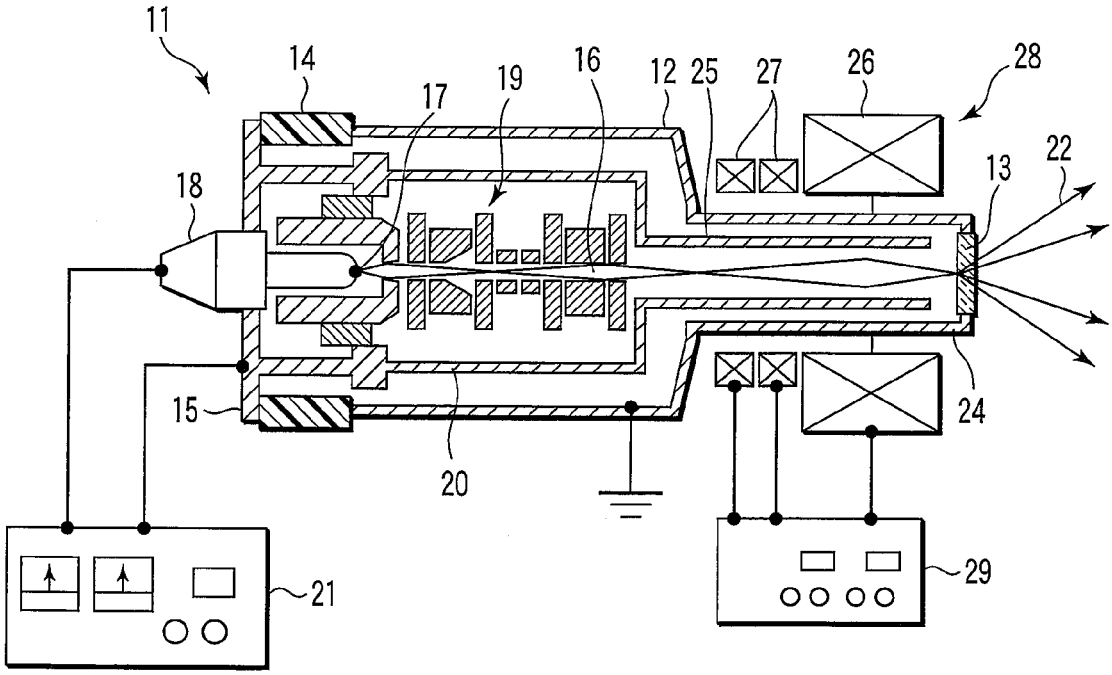
FIG. 2 is an illustrative view of an X-ray source showing a second embodiment of the present invention.

Next, a second embodiment of an X-ray source 11 is shown in FIG. 2.

In the X-ray source 11, a cylinder portion 24 in which a transmission target 13 is arranged at a tip end is formed at one end of a vacuum container 12, and a sleeve 25 through which electron beams 16 converged by means of an electro-optical system 19 and incident to the transmission target 13 pass, is arranged inside this cylinder portion 24. The sleeve 25 is formed at a coverage portion of a support member and is electrically insulated from the vacuum container 12, and then, a positive voltage is applied from a drive power source 21.

A magnetic field type electro-optical system 28 having a magnetic field lens (objective lens) 26 and a magnetic field type multi-poles 27 is arranged outside the cylinder portion 24. The magnetic field lens 26 and the multi-poles 27 are operable to have the same ground potential as that of the vacuum container 12 or the transmission target 13, and are connected with a control power source 29 for generating a magnetic field.

In addition, the magnetic field type electro-optical system 28 is operable to have the same ground potential as that of the transmission target 13 of the vacuum container 12, and the sleeve 25 is configured to be floated at a positive potential like the electro-optical system 19 of the preceding stage, whereby the electron beams 16 maintain the same electric potential as that obtained when they pass through the electro-optical system 19 until they have passed through the magnetic field type optical system 28, and a deceleration action can be applied immediately before the beams are incident to the transmission target 13.

Therefore, a divergence action exerted by a spatial electric charge effect at an image focus point of the electro beams 16 in the electro-optical system 19 and the magnetic field type electro-optical system 28 is reduced, and further, color aberration can be reduced among the aberrations of a lens configuring the electro-optical system 19 and the magnetic field type optical system 28.

By means of the action of restraining divergence of the electron beams 16, the focus of the electron beams 16 at an incident point of the transmission target 13 can be reduced more remarkably than that obtained when the electron beams 16 are passed from a point of generation to a point of incidence to the transmission target 13 with a constant low energy, and X-rays 22 can be radiated from a small focus.

Therefore, there can be provided an X-ray source 11, which is capable of radiating X-rays 22 with low energy at a microscopic focus while employing a configuration provided with the magnetic field type electro-optical system 28.

In particular, as an example of a scanning type electronic microscope shows, a magnetic field lens 26 with more excellent aberration characteristics than that of an electrostatic lens can be easily provided so that application thereof is effective in pursuing a small focus size.

Figure 3:
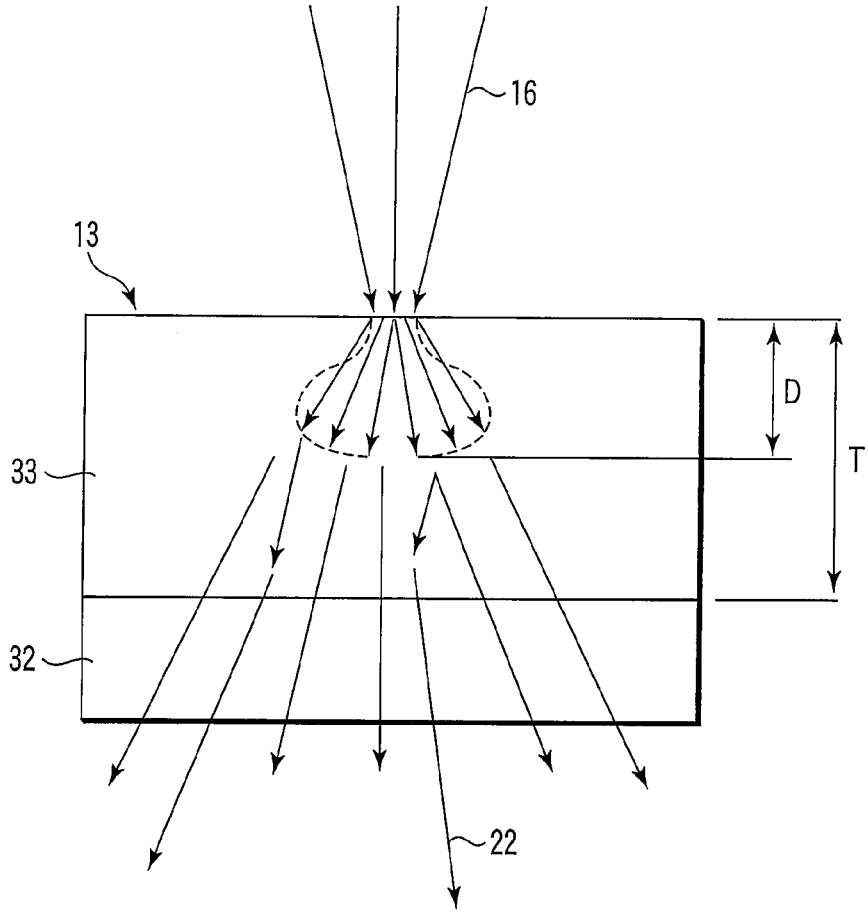
FIG. 3 is a sectional view of a transmission target of each of the same X-ray sources.

Next, the transmission target 13 of each of the embodiments will be described with reference to FIG. 3.

The transmission target 13 is provided with a substrate 32. On this substrate 32, a coating material 33 formed by coating a metal element for radiating X-rays 22 is formed.

The substrate 32 is usually made of Be (beryllium) with a small X-ray damping rate, whereas the coating material 33 is made of a heavy element such as W (tungsten) with a large X-ray emission rate. The electron beams 16 incident to this coating material 33 internally repeat collision and damping, and permeate until a depth equivalent to energy is reached. At that time, the electron beams 16 permeate inside the coating material 33 while they diverge due to their collision action. Thus, the size of an area in which X-rays 22 are generated also increases, namely, the blurring of the X-ray focus occurs. This blurring of the X-ray focus is generally equivalent to an electron permeation depth D, so that the thickness T of the coating material 33 is generally restrained to the order of the electron permeation depth in consideration of the focus size and the intensity of X-rays to be radiated.

However, as in the X-ray source 11 of the present invention, in the case of radiating X-rays 22 with low energy, the energy of the electron beams 16 is restrained to be extremely low. In the case where the electron beams 16 with energy of about 5 keV are used as one example, the permeation depth in the coating material 33 made of W is on the order of 30 nm. In this case, the energy distribution of the X-rays 22 generated in the coating material 33 is obtained as white spectra in which components including a low energy component coexist while 5 keV is defined as a peak. However, in the case where the thickness T of the coating material 33 is set to be large, a high X-ray component appears to be a component that is converted to a low energy component and is radiated in the course of permeating the coating material 33.

Therefore, in the case where an attempt is made to increase the radiation intensity of the X-rays 22 with a low energy component equal to or smaller than 3 keV with the use of the electron beams 16 with energy of 5 keV, optimization can be effected by obtaining the thickness T of the coating material 33 that is several times of the permeation depth D of the electron beams 16. In this case, the size of focus blurring that is exerted by permeation of the electron beams 16 is on the order of 100 nm in consideration of the fact that about the thickness T of the coating material 33 is obtained. Thus, as long as an allowable quantity relative to a target focus size is met, the thickness T of the coating material 33 is increased while an increase in intensity of a target X-ray component with low energy is observed, whereby optimization can be effected.

Accordingly, there can be provided an X-ray source 11, wherein the radiation intensity of X-rays 22 with low energy at a microscopic focus is increased with the use of the transmission target 13 that is obtained by optimizing the thickness T of the coating material 33 at the permeation depth D or more of the electron beams 16.

Next, a material for the substrate 32 of the transmission target 13 according to each of the embodiments will be described with reference to FIGS. 4 and 5.

Figure 4:
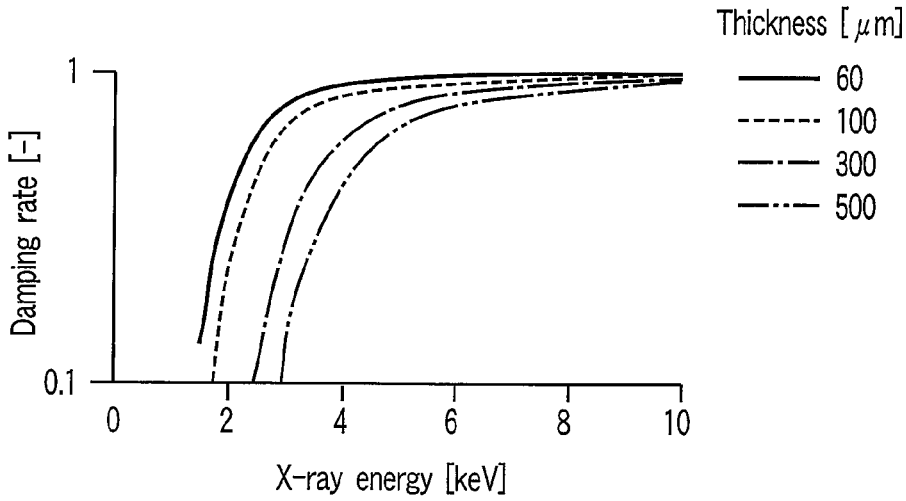
FIG. 4 is a graph depicting a relationship between X-ray energy and a damping rate in thicknesses in the case where a substrate of the same transmission target is made of Be.

FIG. 4 shows a relationship between X-ray energy and a damping rate in thicknesses in the case where the substrate 32 of the transmission target 13 is made of Be. It is generally considered that the substrate 32 of the transmission target 13 is made of Be with a small X-ray damping rate, as described above, whereas a critical thickness of 30 μm to 60 μm is obtained when the substrate 32 made of Be is employed while the performance of a vacuum bulkhead is met. As shown in FIG. 4, the above critical thickness is insufficient in effectively taking out a component of a soft X-ray area of which X-ray energy is equal to or smaller than 2 keV, thus making it necessary to apply other materials such that the critical thickness can be further reduced.

In the X-ray source 11 of the present invention, other materials are applied as those for the substrate 32 of SiC (silicon carbide) or SiN (silicon nitride), which is used as a soft X-ray exit window of radiation equipment. In general, the critical thickness of the substrate 32 made of Be is obtained by the fact that, when a high temperature is reached at the time of bonding with a base made of a SUS material, re-crystallization is effected and the releasing at the grain boundary occurs. SiC and SiN applied herein are mono-crystalline, so that uniform intensity can be maintained even when the grain boundary does not exist and a high temperature is reached, thus making it possible to apply a thin material with the thickness of about 0.1 μm.

Therefore, as FIG. 5 shows a characteristic comparison in the case where the substrate 32 of the transmission target 13 is made of Be and SiN, there can be provided an X-ray source 11, which is capable of radiating soft X-rays with energy equal to or smaller than 2 keV at a permeation rate equal to or greater than 90%, and which is capable of radiating X-rays 22 with high intensity and low energy at a microscopic focus in the case of SiN.

In addition, the transmission target 13 of the X-ray source 11 is assumed to be coated with a metal such as W while the substrate 32 is made of SiC or SiN. This is because conversion efficiency for the X-rays 22 is attempted to be enhanced and metal coating is required to prevent charge-up on the surface of the transmission target 13 since SiC and SiN usually have no conductivity.

However, the substrate 32 made of SiC can have conductivity by controlling a forming condition thereof and the latter reason above can be avoided; therefore, the surface of the substrate 32 does not have to be coated with an element such as W.

As described above, in the case where the surface of the substrate 32 is not coated with an element such as W, Si and C in SiC are collided with the incident electron beams 16 to become target elements for radiating the X-rays 22. However, because they are light elements and the X-rays 22 have low conversion efficiency, in order to increase X-ray intensity, a thickness of the substrate is increased in consideration of the damping of the target X-rays 22.

On an uncoated substrate 32 made of SiC, it becomes also possible to effectively radiate characteristic X-rays, namely, Si—K rays (1.74 keV) or C—K rays (0.28 keV) with the use of electron beams 16 with energy equal to or smaller than 3 keV.

Next, radiation of characteristic X-rays from the transmission target 13 according to each of the embodiments will be described with reference to FIGS. 6A and 6B.

The X-ray source 11 uses control X-rays as X-rays radiated from the transmission target 13, and a spectrum distribution thereof is obtained as a broad continuous distribution (continuous X-rays) while the energy of the incident electron beams 16 is defined as a peak.

Here, a configuration is applied such that characteristic X-rays are effectively radiated from the coating material 33 formed on the surface of the substrate 32.

FIGS. 6A and 6B each show an example of L-rays (with energy equal to or smaller than 10 keV) obtained when an element to be coated on the substrate 32 is selected. By selecting a (metal) element having L-X rays with energy equal to or smaller than 3 keV and selecting the thickness of the coating material 33 and optimization of energy of the incident electron beams 16 (approximately 2 times of characteristic X-ray energy), X-rays 22 including the target characteristic X-rays at a high rate can be radiated. Further, by optimizing the conditions described above on the presumption that there should be the target focus size and the intensity of X-rays to be radiated, there can be provided an X-ray source 11 including characteristic X-rays with a microscopic focus and low energy at a high rate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An X-ray source comprising:

a vacuum container provided with a transmission target being at ground potential;

an electron source, disposed within the vacuum container and insulated from ground potential, the electron source configured to generate an electron beam;

an electro-optical system, disposed within the vacuum container and insulated from ground potential, the electro-optical system configured to converge the electron beam generated by the electron source; and a drive power source configured to distribute electric potential, so that the electron beam converged by the electro-optical system is decelerated immediately prior to being incident on the transmission target.

2. The X-ray source according to claim 1, further comprising:

a sleeve which is accommodated in the vacuum container to be insulated from a ground potential, and through which an electron beam converged by the electro-optical system and oriented to the transmission target passes;

a magnetic field type electro-optical system disposed outside the vacuum container at a position of the sleeve; and a control power source which controls the magnetic field type electro-optical system.

3. The X-ray source according to claim 1, wherein the transmission target comprises a substrate and a coating material that is provided at a thickness equal to or greater than a permeation depth of an electron beam incident to a surface of the substrate.

4. The X-ray source according to claim 1, wherein the transmission target comprises a substrate having a thickness of 1 μm or less and made of either SIC or SIN.

5. The X-ray source according to claim 1, wherein the transmission target comprises a substrate made of conductive SiC, of which a coating material is not applied on a surface.

6. The X-ray source according to claim 1, wherein the transmission target comprises a substrate and a coating material for radiating a characteristic X-ray, the coating material being provided on a surface of the substrate.

7. The X-ray source according to claim 2, wherein the transmission target comprises a substrate and a coating material that is provided at a thickness equal to or greater than a permeation depth of an electron beam incident to a surface of the substrate.

8. The X-ray source according to claim 2, wherein the transmission target comprises a substrate having a thickness of 1 μm or less and made of either SiC or SiN.

9. The X-ray source according to claim 2, wherein the transmission target comprises a substrate made of conductive SiC, of which a coating material is not applied on a surface.

10. X-ray source according to claim 2, wherein the transmission target comprises a substrate and a coating material for radiating a characteristic X-ray, the coating material being provided on a surface of the substrate.

* * * * *